US006679654B1

(12) United States Patent
Wittenberg et al.

(10) Patent No.: US 6,679,654 B1
(45) Date of Patent: Jan. 20, 2004

(54) FLOOD CONTROL SYSTEM

(75) Inventors: Donn Wittenberg, Knoxville, TN (US); Charles T. Shankles, Knoxville, TN (US); Bruce A. Knobloch, Harriman, TN (US)

(73) Assignee: Aqua Levee Enterprises, LLC, Harriman, TN (US)

( * ) Notice: Subject to any disclaimer, the term of this patent is extended or adjusted under 35 U.S.C. 154(b) by 0 days.

(21) Appl. No.: 10/352,018

(22) Filed: Jan. 27, 2003

(51) Int. Cl.[7] ..... E02B 7/02

(52) U.S. Cl. ..... 405/115; 404/6; 52/2.11; 256/13; 405/111; 405/114

(58) Field of Search ..... 405/110, 111, 405/114, 115; 256/1, 13, 19; 404/6; 52/2.11, 174

(56) References Cited

U.S. PATENT DOCUMENTS

| | | | | |
|---|---|---|---|---|
| 3,213,628 A | | 10/1965 | Serota | |
| 3,680,319 A | | 8/1972 | Draper et al. | |
| 4,330,224 A | | 5/1982 | Muramatsu et al. | |
| 4,692,060 A | | 9/1987 | Jackson, III | |
| 4,784,520 A | | 11/1988 | Stevens | |
| 4,921,373 A | | 5/1990 | Coffey | |
| 4,966,491 A | | 10/1990 | Sample | |
| 4,973,947 A | | 11/1990 | Tax | |
| 5,040,919 A | | 8/1991 | Hendrix | |
| 5,125,767 A | | 6/1992 | Dooleage | |
| 5,176,468 A | | 1/1993 | Poole | |
| 5,236,281 A | | 8/1993 | Middleton | |
| 5,283,569 A | | 2/1994 | Nelson | |
| 5,439,316 A | | 8/1995 | Richardson | |
| 5,470,177 A | | 11/1995 | Hughes | |
| 5,511,902 A | | 4/1996 | Center | |
| 5,552,774 A | | 9/1996 | Gridley | |
| 5,632,573 A | | 5/1997 | Baker | |
| 5,836,714 A | * | 11/1998 | Christensen | 404/6 |
| 5,857,806 A | | 1/1999 | Melin | |
| 5,865,564 A | | 2/1999 | Miller et al. | |
| 5,971,661 A | | 10/1999 | Johnson et al. | |
| 6,012,872 A | * | 1/2000 | Perry et al. | 405/114 |
| 6,164,870 A | * | 12/2000 | Baruh | 405/114 |
| 6,334,736 B1 | | 1/2002 | Johnson et al. | |
| 6,390,154 B1 | | 5/2002 | Hall | |
| 6,428,240 B1 | | 8/2002 | Ehrlich et al. | |

* cited by examiner

*Primary Examiner*—Robert E. Pezzuto
*Assistant Examiner*—Tara L. Mayo
(74) *Attorney, Agent, or Firm*—Luedeka Neely & Graham, P.C.

(57) ABSTRACT

A flood control system including a substantially rigid exterior shell and a flexible bladder having one or more valves for introducing and removing a desired amount of fluid, the shell including opposite first and second rigid sides hingedly connected to one another to permit the shell to be positioned in a desired orientation exterior to and substantially overlying the flexible bladder.

6 Claims, 8 Drawing Sheets

FLOOD CONTROL SYSTEM

FIELD OF THE INVENTION

This invention relates generally to devices for impeding flood waters. More particularly, this invention relates to portable flood control devices that can be integrated for impeding flood waters over a relatively large area.

BACKGROUND AND SUMMARY OF THE INVENTION

Improvement is desired in the construction of portable flood control devices. Accordingly, the present invention is directed to a flood control system having improved construction.

In a preferred embodiment, the flood control system of the invention includes a substantially rigid exterior shell and a flexible bladder having one or more valves for introducing and removing a desired amount of fluid. The shell includes opposite first and second rigid sides hingedly connected to one another to permit the shell to be positioned in a desired orientation exterior to and substantially overlying the flexible bladder.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
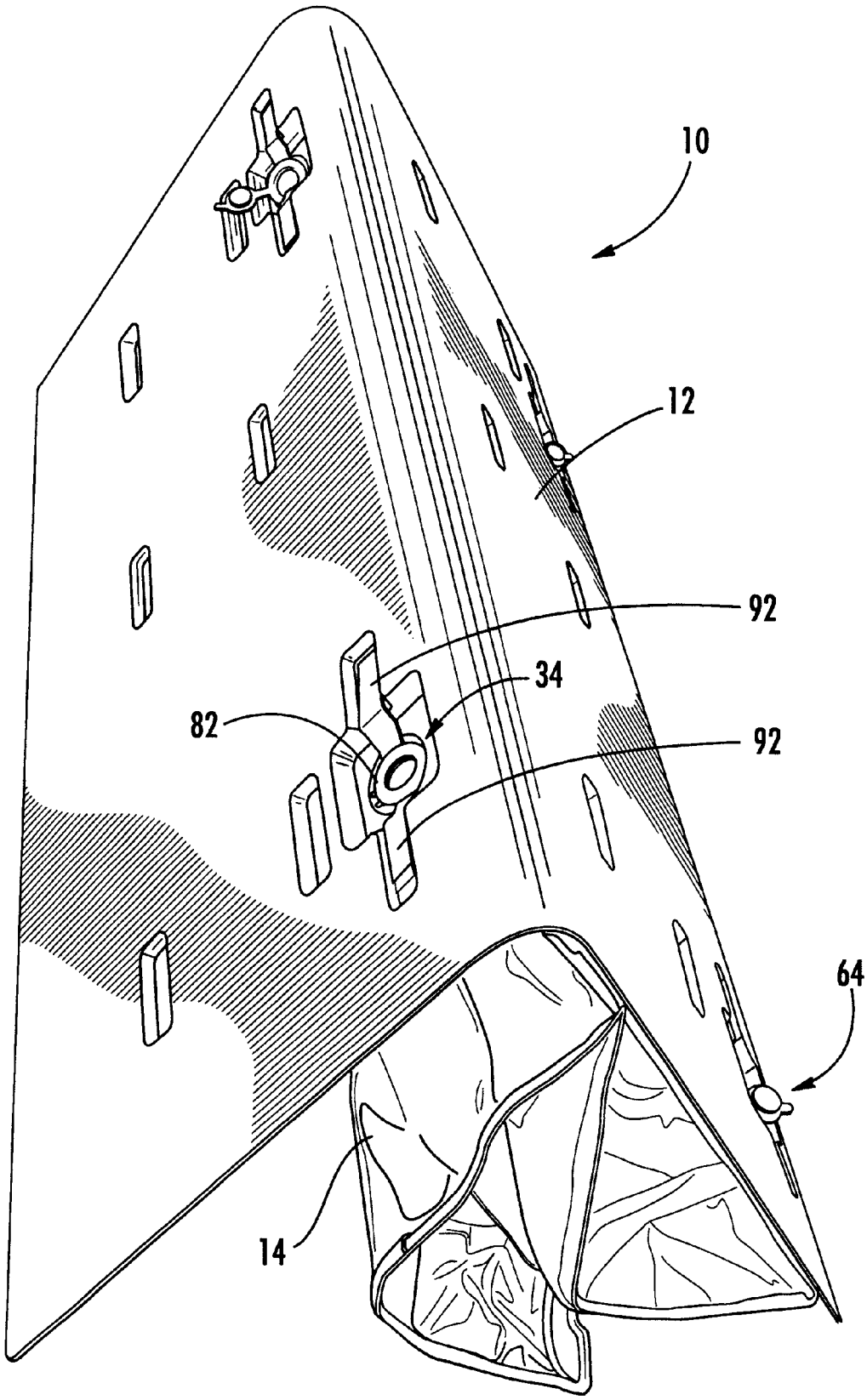
FIG. 1 is a perspective view of a flood control system according to a preferred embodiment of the invention.
Figure 2:
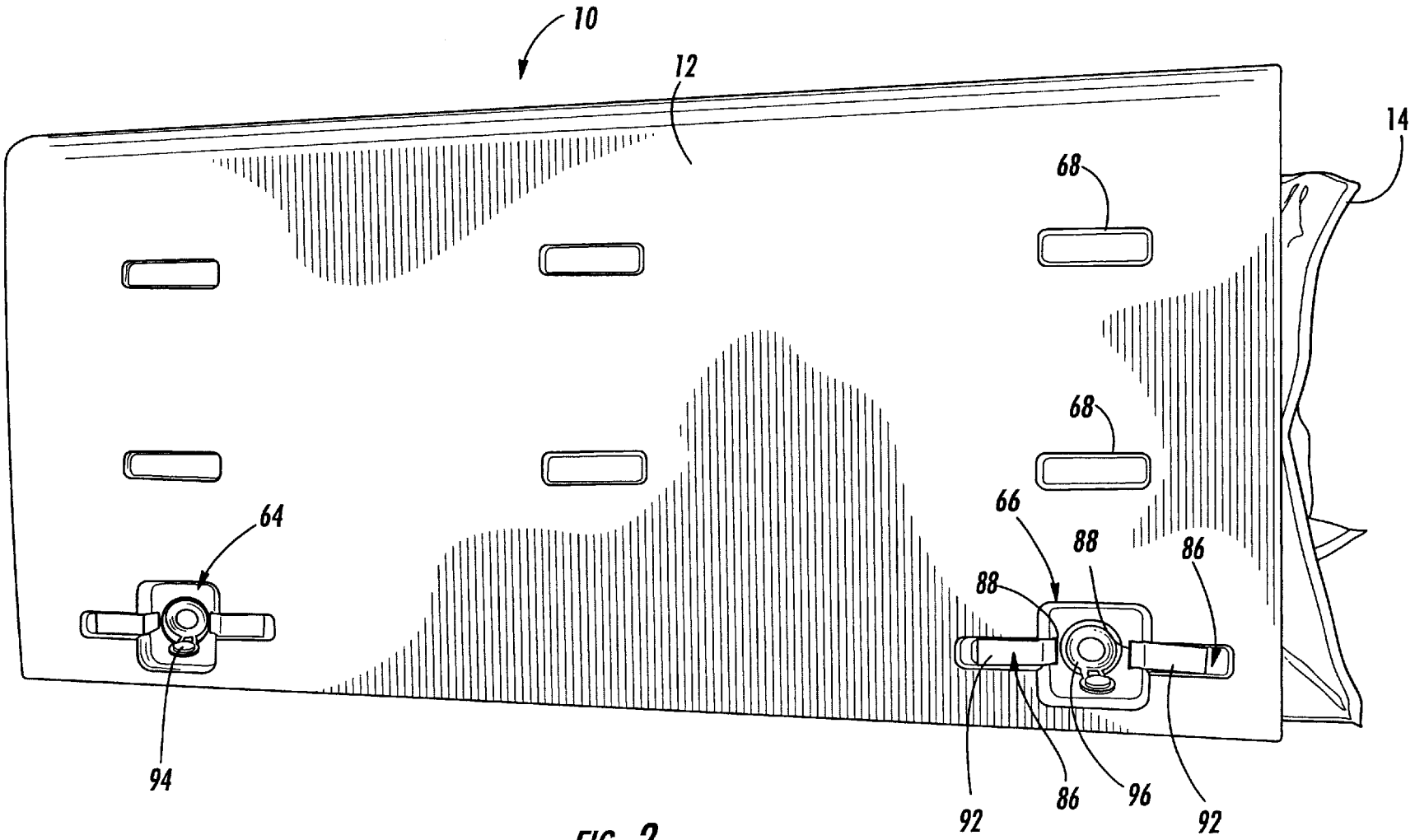
FIG. 2 is a side view of the flood control system of FIG. 1.

With initial reference to FIGS. 1 and 2, the invention relates to a flood control system 10 having as major components a substantially rigid exterior shell 12 which overlies a flexible bladder 14 configured for retaining a desired amount of a fluid, preferably a liquids such as water. The system 10 may be of any desired length and height, however, for the purpose of example the system has a length of about 6 feet and an erected height of about 2 feet.

Figure 3:
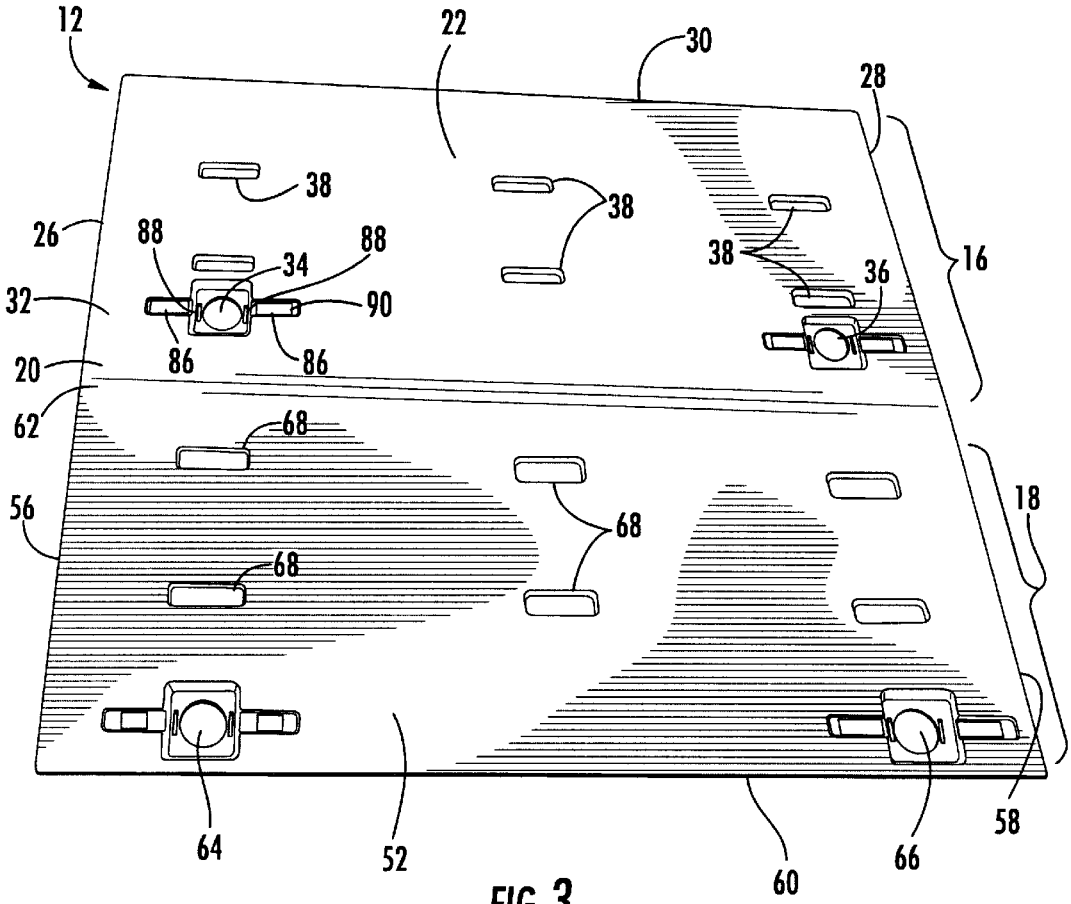
FIG. 3 shows exterior surfaces of a shell component of the flood control system of FIG. 1.
Figure 4:
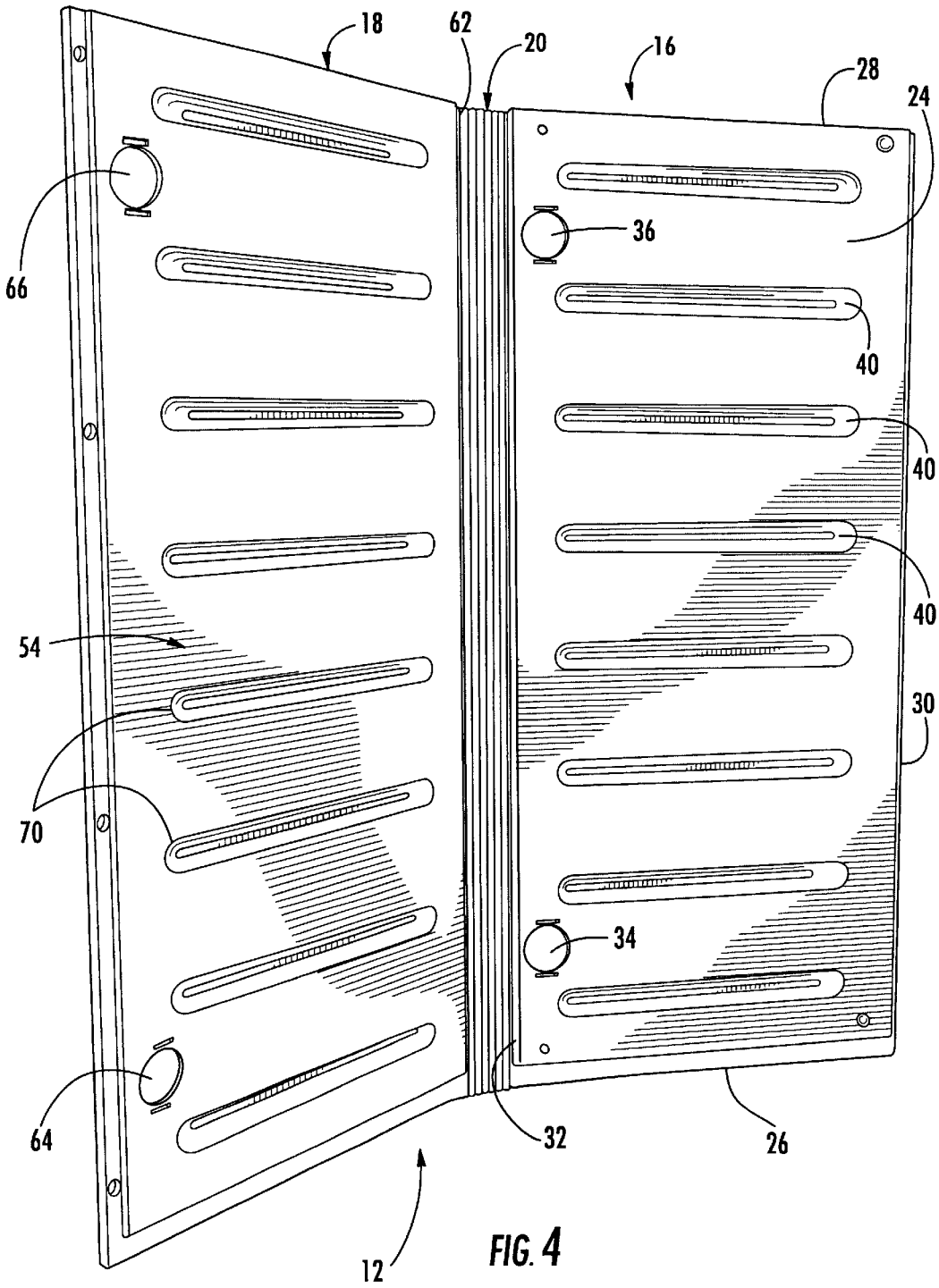
FIG. 4 shows interior surfaces of the shell of FIG. 3.

With reference to FIGS. 3 and 4, the shell 12 is preferably of one-piece blow-molded plastic construction configured to have opposite rigid sides 16 and 18 hingedly connected to one another by a living hinge 20 that substantially bisects the shell 12. The hinge 20 permits a range of motion such that the shell 12 may be oriented in a triangular orientation as seen in FIG. 1 during use. The range of motion also permits the shell 12 to be laid flat as seen in FIGS. 3 and 4 or folded so that the sides 16 and 18 abut to provide a compact configuration for storage and transportation purposes.

The side 16 has exterior surface 22, opposite interior surface 24, opposite side edges 26 and 28, lower edge 30 and upper edge 32 that connects to the hinge 20. A pair of fill apertures 34 and 36 extend between the surfaces 22 and 24 adjacent the upper edge 32. The side 16 preferably includes as molded features a plurality of handholds 38 defined on the exterior surface 22 to facilitate lifting of the shell 12 by a user.

Figure 5:
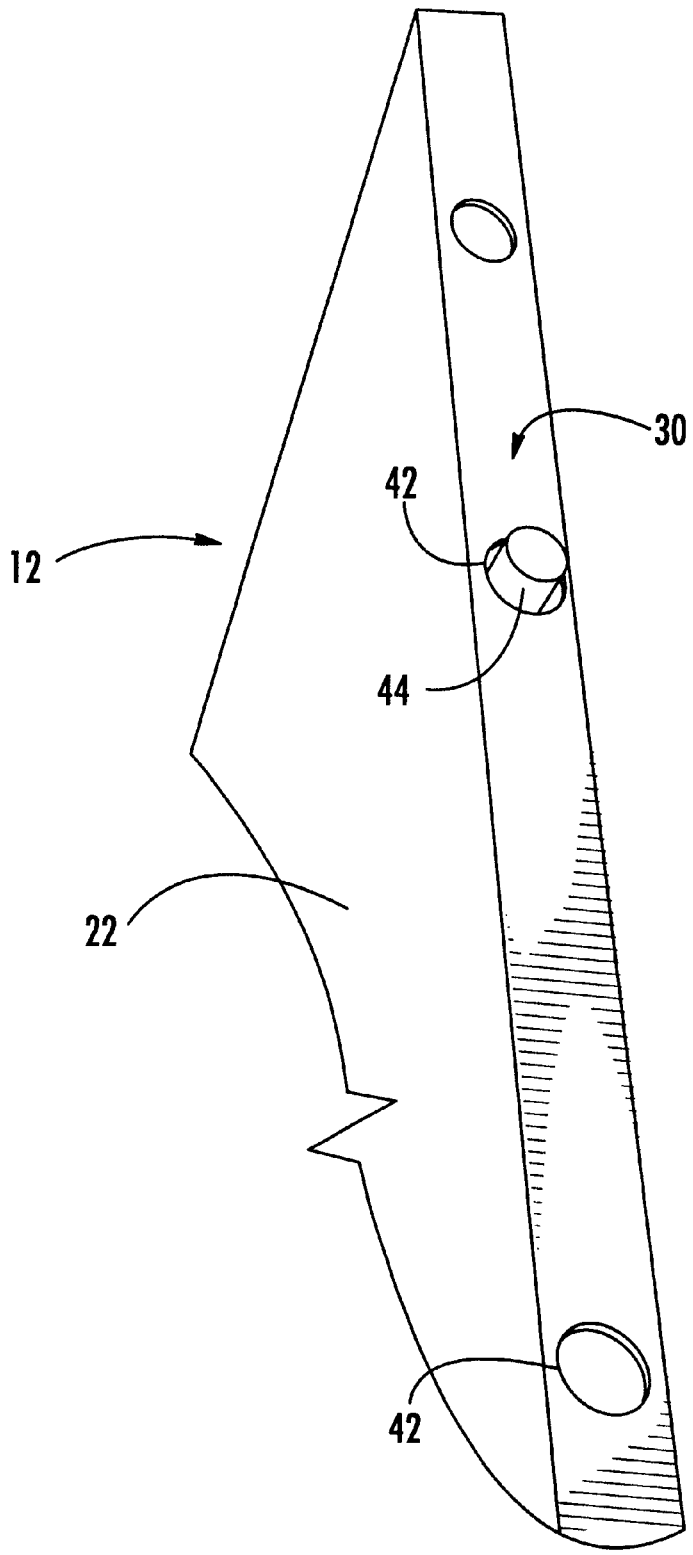
FIG. 5 is a close-up view of a lower edge of the shell of FIG. 3.

To enhance the rigidity of the side 16, a plurality of ribs 40 (FIG. 4) preferably extend across the width of the side 16. Also, with reference to FIG. 5, apertures 42 may be provided at spaced apart intervals of the lower edge 30 for receiving conduit, such as aluminum conduit 44 for enhanced rigidity. The conduits 44 may also extend outside of the apertures 42 for engaging the ground surface upon which the shell 12 is placed.

The side 18 includes exterior surface 52, opposite interior surface 54, opposite side edges 56 and 58, lower edge 60 and upper edge 62 that connects to the hinge 20. A pair of drain apertures 64 and 66 extend between the surfaces 52 and 54 adjacent the lower edge 60. The side 18 also preferably includes as molded features handholds 68 and ribs 70 corresponding to the handholds 38 and ribs 40. The side 18 may also include apertures and conduits corresponding to the previously described apertures 42 and conduits 44.

Figure 6:
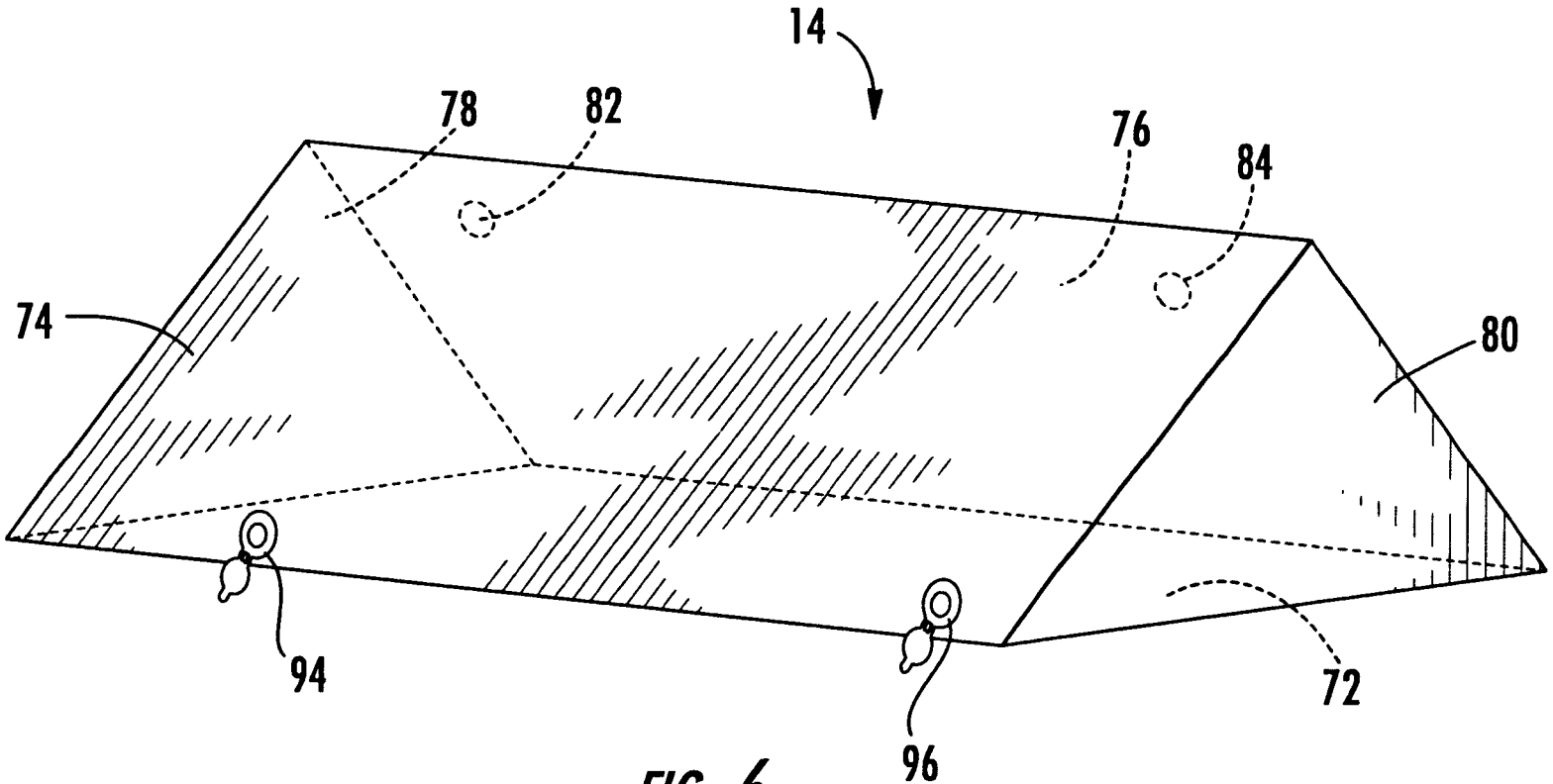
FIG. 6 is a perspective view of a bladder of the flood control system of FIG. 1 in a filled state.
Figure 7:
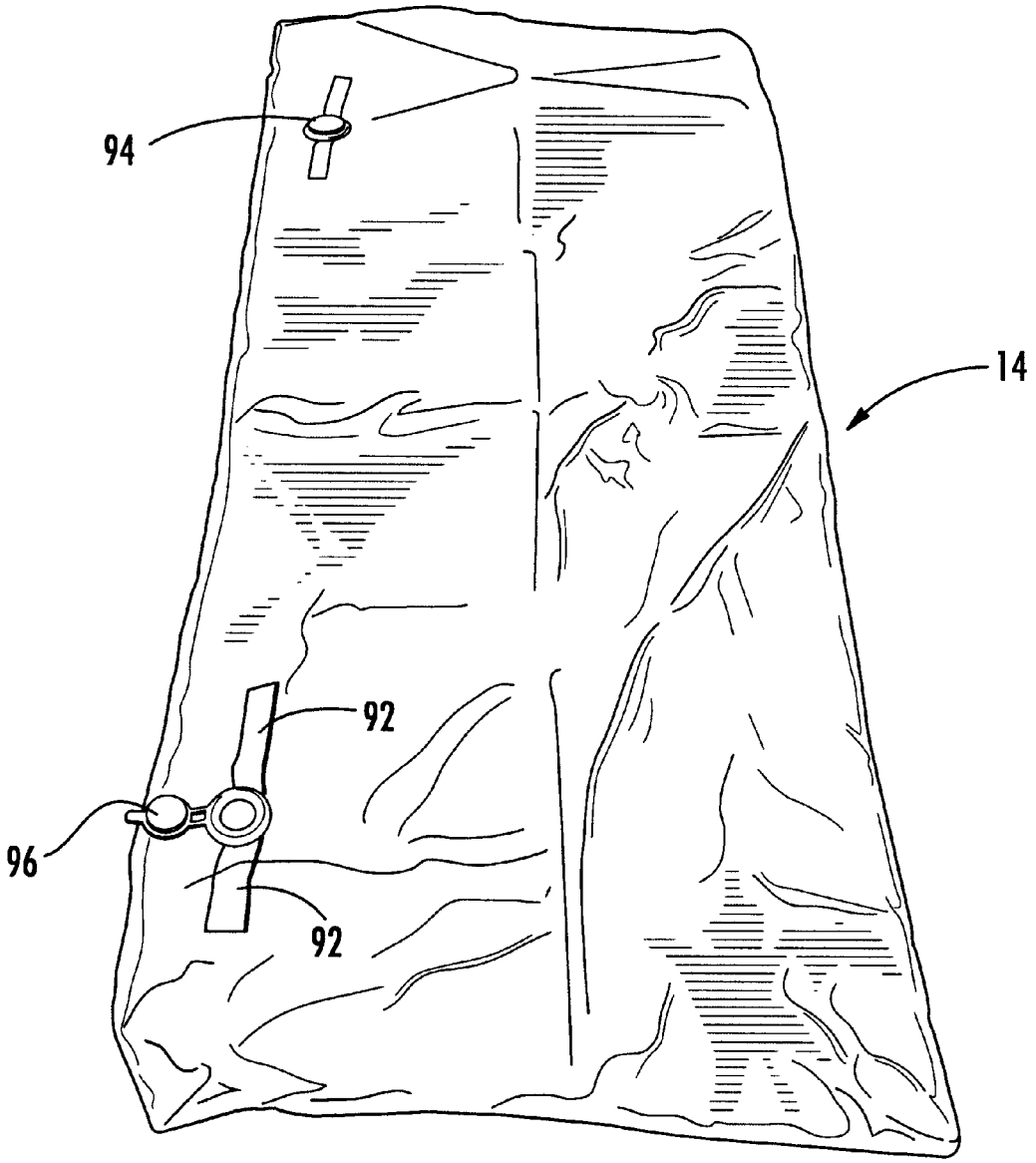
FIG. 7 shows the bladder of FIG. 6 in an unfilled state.

Turning now to FIGS. 6 and 7, the bladder 14 is elongated and preferably triangular in shape and forms an isosceles triangle when inflated as by filling with fluid. In this regard, the bladder 14 preferably includes bottom 72, sides 74 and 76, and opposite ends 78 and 80. The bladder 14 is preferably made of a flexible plastic sheet material such as polyvinyl chloride, with fluid tight seams formed as by welds at the joints between the bottom, sides, and ends so that the interior of the bladder 14 defines a cavity for receiving and retaining fluid. The bladder 14 is preferably sized so that it fits under the erected shell 12. As described below, the bladder 14 preferably has a length slightly greater than the length of the shell 12.

The side 76 preferably includes a pair of fill valves 82 and 84 located adjacent opposite ends thereof and closely adjacent the junction of the side 78. The fill valves 82 and 84 may be apertures with sealable caps and are preferably located to correspond to the locations of the fill apertures 34 and 36 of the shell 12 to permit introduction of fluid into the bladder 14. Returning to FIG. 3, the apertures 34 and 36 each preferably include as co-molded topographical features an elongate recess 86 that spans the aperture, slots 88 adjacent each side of the aperture, and strap securement devices 90, such as strips of hook or loop material secured to the recess as by adhesive.

The recess 86, slots 88, and securement devices 90 of each fill aperture of the shell 12 cooperate with straps 92 having loop or hook material on the ends thereof and associated with each of the fill valves 82 and 84 of the bladder 14 to releasably secure the valves 82 and 84 relative to the apertures 34 and 36. For example, the valve 82 is positioned to extend through the aperture 32, with the straps 92 thereof extending through the slots 88. The hook/loop material at the ends of the straps 92 are then secured to the loop/hook material of the securement devices 90.

The bladder 14 preferably includes a pair of drain valves 94 and 96 located adjacent opposite ends thereof and closely adjacent the junction of the bottom 72. The drain valves 94 and 96 may be apertures with sealable caps and are preferably located to correspond to the locations of the drain apertures 64 and 66 of the shell 12 to permit release of fluid from the bladder 14. In this regard, the drain valves 94 and 96 and the drain apertures 64 and 66 are preferably substantially similar in construction to the fill valves 82 and 84 and the fill apertures 34 and 36 and cooperate in a similar manner to releasably secure the valves 64 and 66 relative to the apertures 34 and 36. The drain and fill valves are preferably located at each end to facilitate filling/draining of the system even if the system is used on sloping ground.

Figure 8:
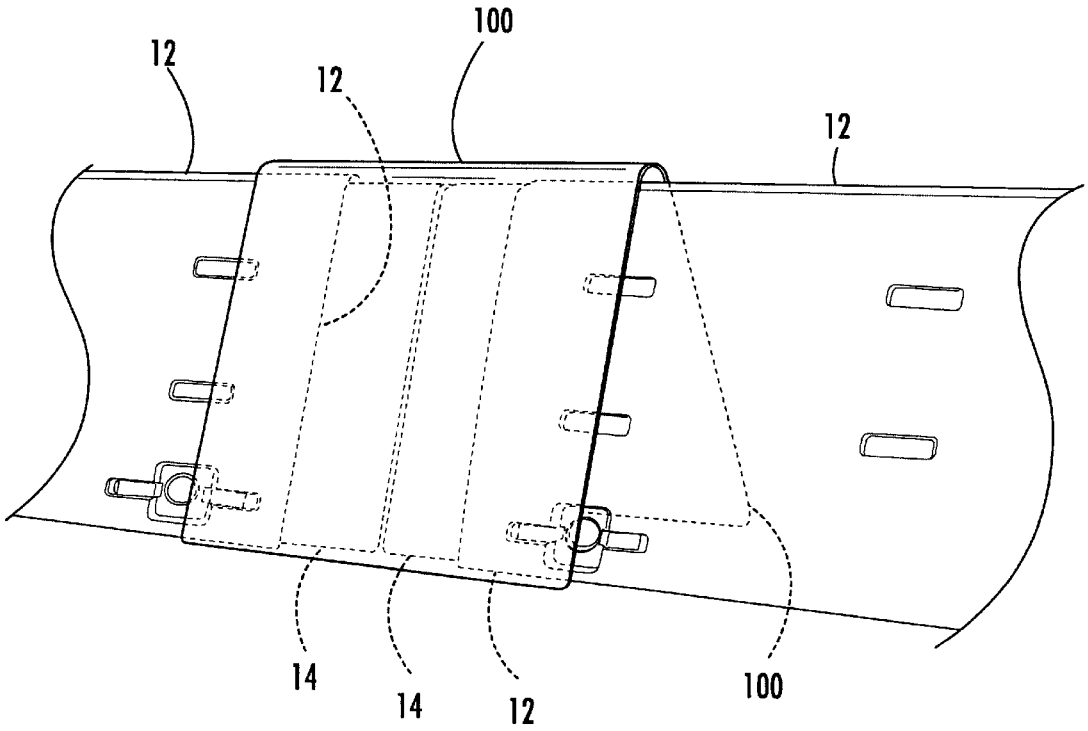
FIG. 8 shows an overlapping shell section for use with adjacent systems.

Each system 10 may be used to impede flood waters alone or in combination with multiple other of the systems 10. For example, a plurality of the systems 10 may be placed end-to-end. In this regard, it is noted that the length of the bladder 12 is preferably slightly longer than the length of the shell 12 so that the bladder extends outwardly from each end of the shell 12. For example, for a shell 12 having a length of about 65 inches, the bladder 14 preferably has a length of about 70 inches. This excess length of the bladder enables the bladders of adjacent systems to bear against one another to substantially seal the interface against passage of flood waters. This arrangement also enables the systems to be angularly oriented relative to one another without compromising their ability to impede flood waters. If desired, a shell section 100 (FIG. 8) corresponding to the shell 12 but having a length slightly greater than the length of the exposed bladder portions of the abutting bladders and a height slightly greater than the shell 12 (so as to overly the adjacent shells 12) may be positioned to overly the exposed portions of the abutting bladders to protect them from damage such as puncture and for aesthetics. Thus, the shell section 100 is preferably identical to the shell 12 and includes a pair of hingedly connected sides, but does not include apertures for valves and is shorter but wider to have a greater erected height so as to overlie the adjacent shells 12.

The systems 10 may also be stacked, placed side to side, and otherwise arranged to provide a flood impeding barrier to fit a variety of flood situations. For example, the overall height of the barrier provided may be increased by placing two of the systems 10 side-by-side, with one of the systems 10 (or just the bladder 14 thereof) inverted between them. A further system 10 may then be stacked on top of the middle system or bladder to increase the barrier height.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A flood control system, comprising a substantially rigid exterior shell erectable into a desired shape and a flexible bladder having a corresponding shape when filled with a fluid and including one or more valves for introducing and removing a desired amount of fluid to and from the bladder, the shell having a length and including opposite first and second rigid sides hingedly connected to one another to permit the shell to be positioned in a desired orientation exterior to and substantially overlying the flexible bladder, with the bladder having a length that is greater than the length of the shell and sufficient to enable the bladders of adjacent systems to bear against one another to substantially seal the interface against passage of flood water.

2. The system of claim 1, wherein the shell is of one-piece molded plastic construction.

3. The system of claim 1, wherein the shell is erectable into a substantially triangular configuration and the bladder is substantially triangular in configuration when filled with fluid.

4. The system of claim 1, wherein the shell includes an aperture configured and positioned to receive one of the valves of the bladder.

5. The system of claim 4, wherein the valve includes a pair of straps and the aperture of the shell includes slots for receiving the straps for securing the valve adjacent the aperture of the shell.

6. A flood control system, comprising a substantially rigid exterior shell erectable into a desired shape and a flexible bladder having a corresponding shape when filled with a fluid and including one or more valves for introducing and removing a desired amount of fluid to and from the bladder, wherein the valve includes a pair of straps and the aperture of the shell includes slots for receiving the straps for securing the valve adjacent the aperture of the shell and the shell includes opposite first and second rigid sides hingedly connected to one another to permit the shell to be positioned in a desired orientation exterior to and substantially overlying the flexible bladder.

* * * * *